US007543533B2

(12) United States Patent
Montefusco

(10) Patent No.: US 7,543,533 B2
(45) Date of Patent: Jun. 9, 2009

(54) FIREBALL GENERATOR

(76) Inventor: Vincent Montefusco, P.O. Box 387, Mammoth Lales, CA (US) 93546

( * ) Notice: Subject to any disclaimer, the term of this patent is extended or adjusted under 35 U.S.C. 154(b) by 729 days.

(21) Appl. No.: 11/199,861

(22) Filed: Aug. 8, 2005

(65) Prior Publication Data

US 2007/0031770 A1 Feb. 8, 2007

(51) Int. Cl.
*F42B 12/46* (2006.01)

(52) U.S. Cl. ..... 102/370; 102/363; 102/364; 431/269

(58) Field of Classification Search ..... 102/335, 102/355, 363, 364, 365, 367, 368, 369, 370; 431/267, 269, 270
See application file for complete search history.

(56) References Cited

U.S. PATENT DOCUMENTS 1,588,234 A * 6/1926 Kauch et al. ..... 169/28
3,188,954 A * 6/1965 Roach et al. ..... 102/369
4,392,432 A * 7/1983 Fenrick et al. ..... 102/334
6,349,650 B1 * 2/2002 Brunn et al. ..... 102/368
2006/0166171 A1 * 7/2006 Preston et al. ..... 434/16
2006/0233050 A1 * 10/2006 Unsworth et al. ..... 367/144

FOREIGN PATENT DOCUMENTS

FR 2598215 A1 * 11/1987
FR 2642160 A3 * 7/1990
FR 2709541 A1 * 3/1995

* cited by examiner

*Primary Examiner*—James S Bergin
(74) *Attorney, Agent, or Firm*—Irving Keschner

(57) ABSTRACT

A reusable special effects audible and visual fireball generator device which comprises a cylindrical main housing having end caps mounted at each end. A gas container is positioned within the housing and a knife blade is mounted within the housing adjacent one end cap. A holder containing a predetermined amount of black sporting powder is secured within the housing adjacent the other end cap. When the black sporting powder is ignited, the gas container is forced against the knife blade, rupturing the tank. The released liquid gas mixes with air and the black sporting powder igniting the mixture and providing a fireball effect.

6 Claims, 4 Drawing Sheets

12
13
14
16
20
24
27
28
32
34
40
42
50
51
53
59

FIREBALL GENERATOR

BACKGROUND OF THE INVENTION

1. Field of the Invention

A reusable device for producing a safe and consistent sized gas fireball effect for various non-destructive device uses.

2. Description of the Prior Art

Devices for producing fireballs have been available in the prior art. The typical prior art device comprises black powder contained in a cardboard cup, capped and wrapped tightly with tape and placed on a fuel source such as gasoline, in a non-metal container.

The prior art fireball generators have at least one important limitation; once ignited, the device can not be reused.

What is desired is to provide a device for producing a gas fireball using a commercially available gas bottle, many of the device components being recoverable, and thus reusable after generation of the fireball.

SUMMARY OF THE INVENTION

A fireball generator device comprising a steel cylindrical main housing having first and second threaded end caps, a gas containing tank being positioned within the interior of the housing. A plastic cup is attached to the second threaded end cap and a small electric igniter is placed through a hole formed in the cup. Electric igniter lead wires are positioned on the outside of the housing. The cup is then filled with black sporting powder and a cap is secured to the cup to contain the powder. The device is then placed where the fireball is to be generated and the main electric battery wires are connected to the igniter wires exiting the housing end cap. When conditions are safe, the igniter inside the cup is ignited via a battery or blasting machine.

The powder then explodes within the cup, the resulting high pressure and temperature gases melting the cup so that it disengages from the cap and pushing the cup up against the top of the LPG tank (or a same sized tank having an equivalent ignitable type gas) forcing it forward at a high rate of speed. The gases are contained within a small area around the top of the tank to provide maximum gas pressure by using a steel insert sleeve that is adjacent to the outside diameter of the tank. As the tank moves forward, the gas pressure safely escapes through a series of patterned holes formed around the circumference of the housing releasing the built up pressure. At this time, the bottom of the tank slams into a puncture mechanism having a portion thereof set inside slots formed at one end of the housing. The mechanism rips open the tank bottom, instantaneously releasing the liquid gas from the tank. The gas released from the tank is vented to the outside of the pipe through the patterned holes and mixes with air, the black sporting powder igniting the tank gas and creating a fireball.

To reuse, the user opens the second end cap and replaces the tank, black powder cup, cap and igniter and starts the process over again. The first and second end caps and cylindrical housing, both preferably fabricated from steel, are cold to the touch immediately after the fireball due to the liquid gas being expelled from the vented holder. Since the fireball lasts between 1 and 3 seconds, the steel end caps and cylindrical housing remain relatively cool and thus not heat damaged, allowing these components to be reused.

DESCRIPTION OF THE DRAWINGS

For a better understanding of the present invention as well as other objects and further features thereof reference is made to the following description which is to be read in conjunction with the accompanying drawing therein.

DESCRIPTION OF THE INVENTION

Figure 1:
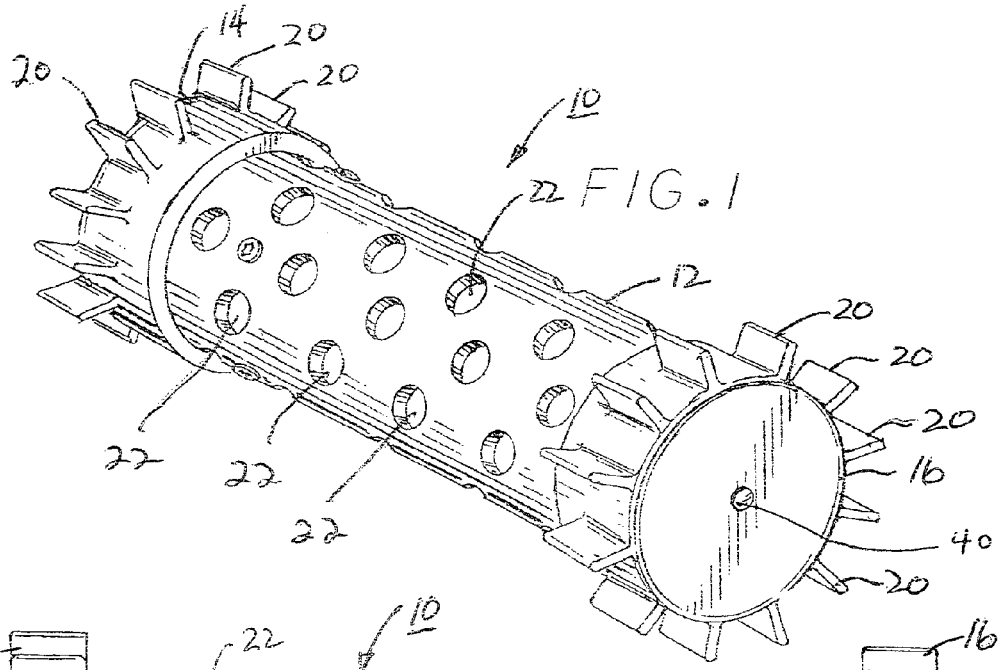
FIG. 1 is a perspective view of the fireball generator device of the present invention illustrating the 360 degree hole pattern.
Figure 2:
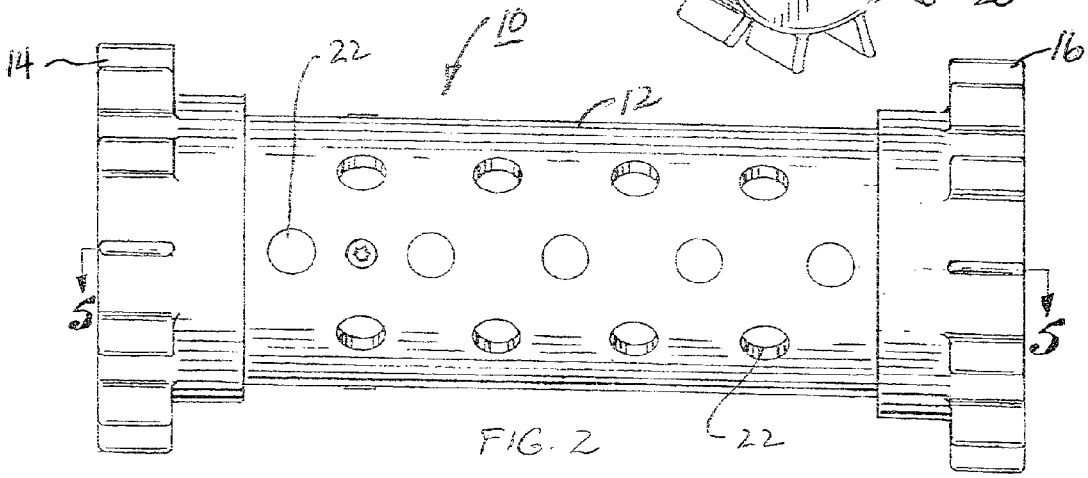
FIG. 2 is a side plan view of the device shown in FIG. 1.
Figure 3:
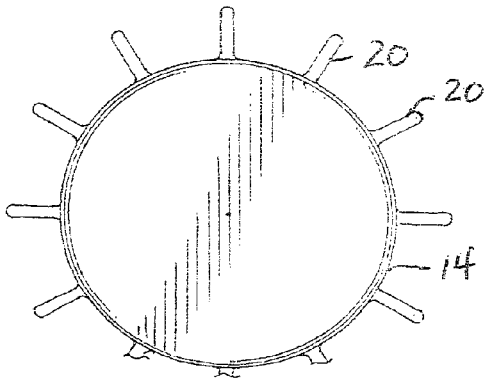
FIG. 3 is one end view of the device shown in FIG. 1.
Figure 4:
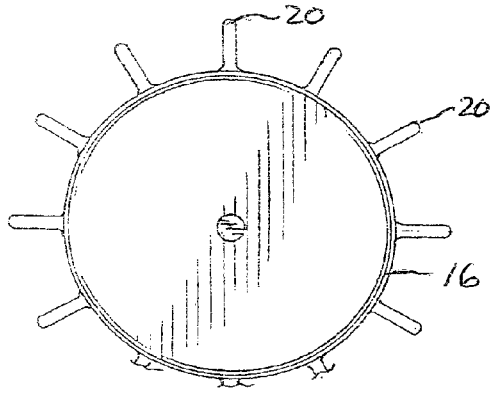
FIG. 4 is the other end view of the device shown in FIG. 1.
Figures 5, 6, 7:
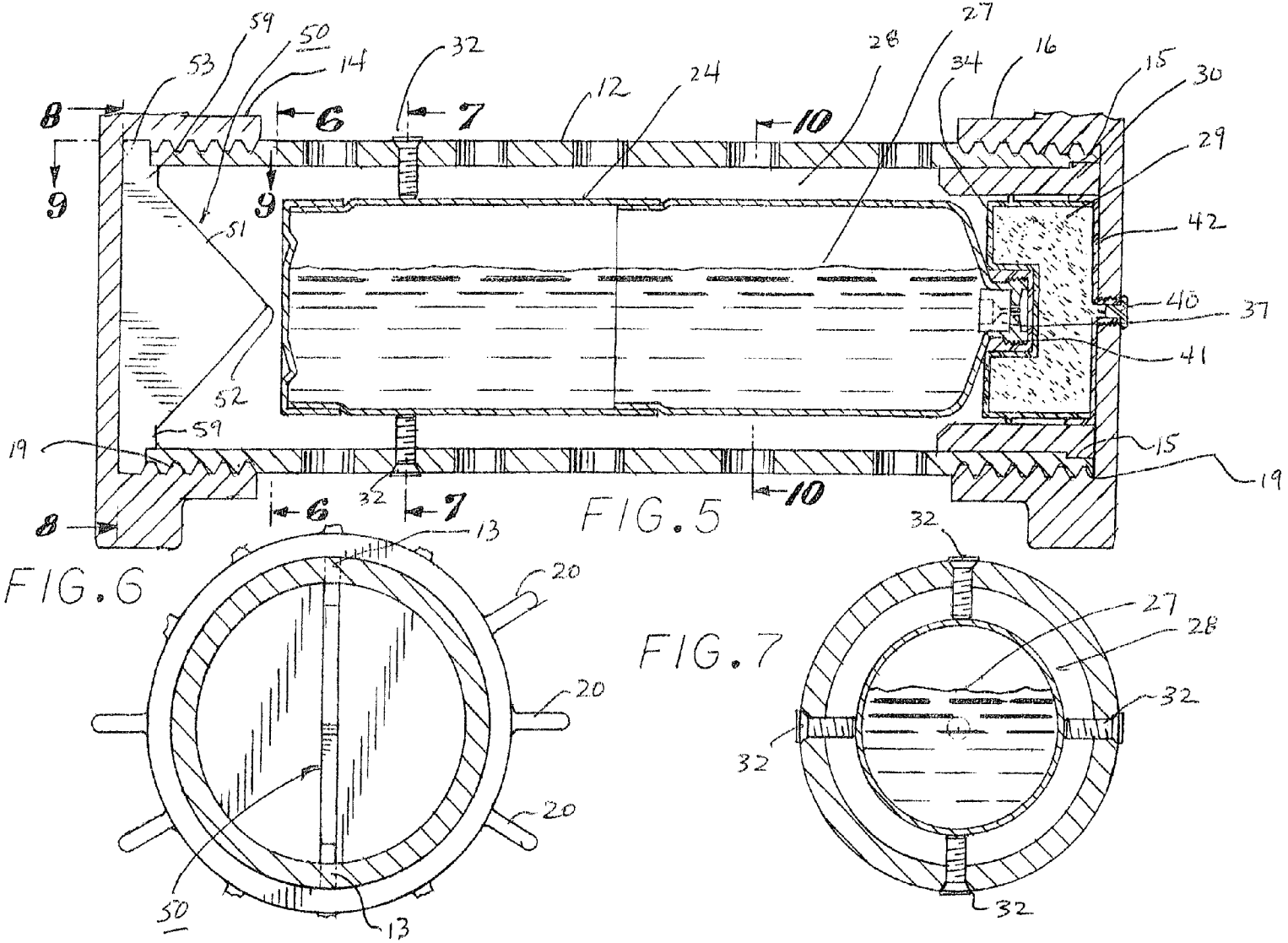
FIG. 5 is a cross-sectional view along line 5-5 of FIG. 2.
FIG. 6 is a cross-sectional view taken on line 6-6 of FIG. 5 showing the blade therein.
FIG. 7 is a cross-sectional view along line 7-7 of FIG. 5 showing the four centering screws for the gas cylinder.
Figures 8, 9, 10, 11:
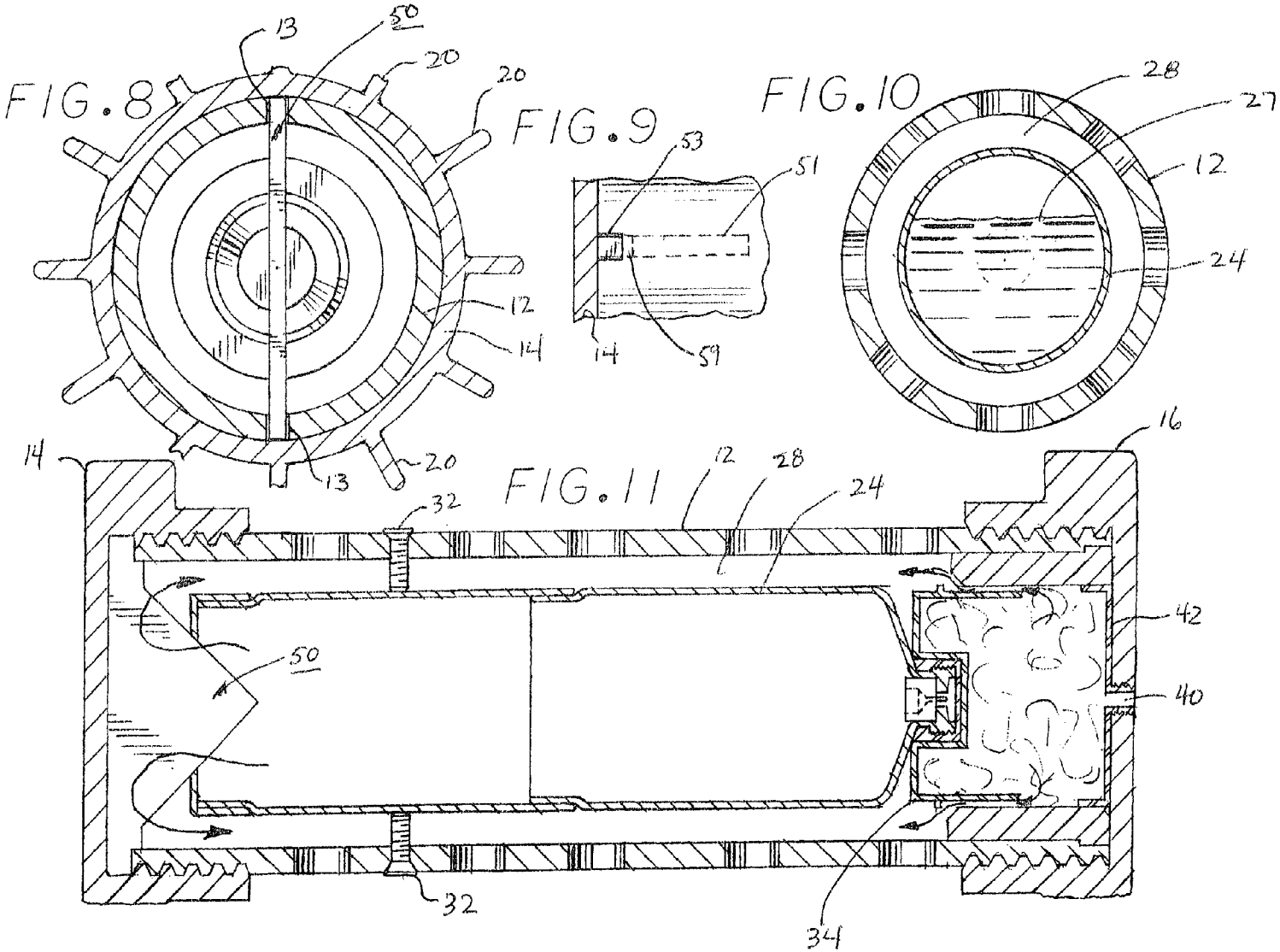
FIG. 8 is a cross-sectional view along line 8-8 of FIG. 5 showing the notches in the housing to support the blade.
FIG. 9 is a cross-sectional view along line 9-9 of FIG. 5 showing the sharpness of the blade.
FIG. 10 is a cross-sectional view along line 10-10 of FIG. 5 showing the 360 degree hole pattern.
FIG. 11 is a cross-sectional similar to FIG. 5 showing the device after the explosive has exploded and driven the gas bottle into the blade.
Figure 12:
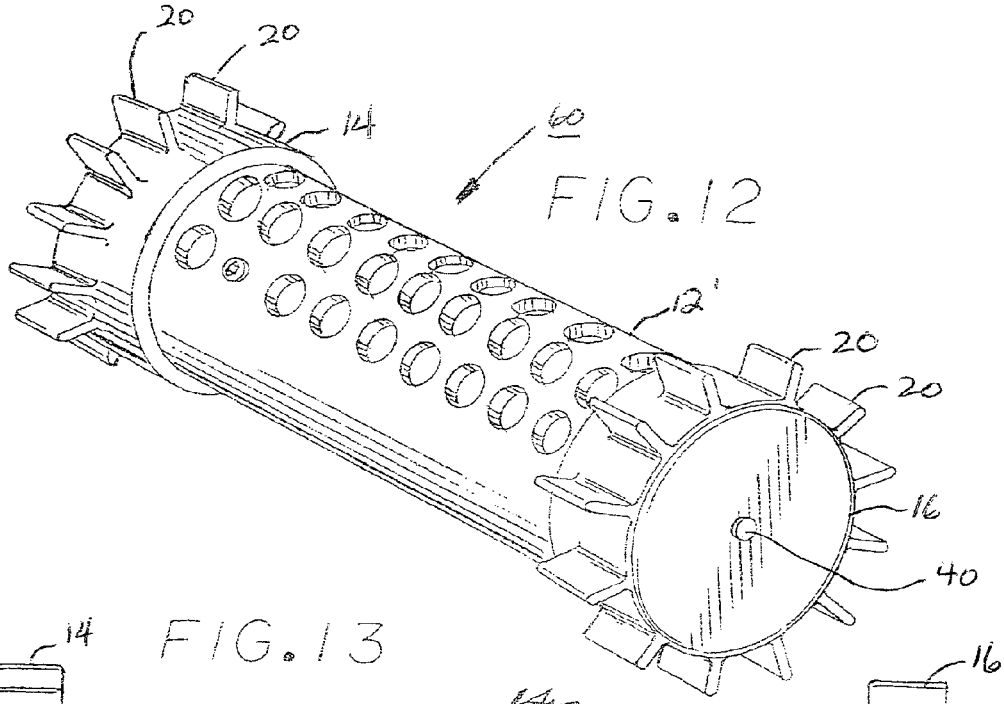
FIG. 12 is a perspective view of the fireball generator device showing a different hole pattern formed in the surface of the housing.
Figure 13:
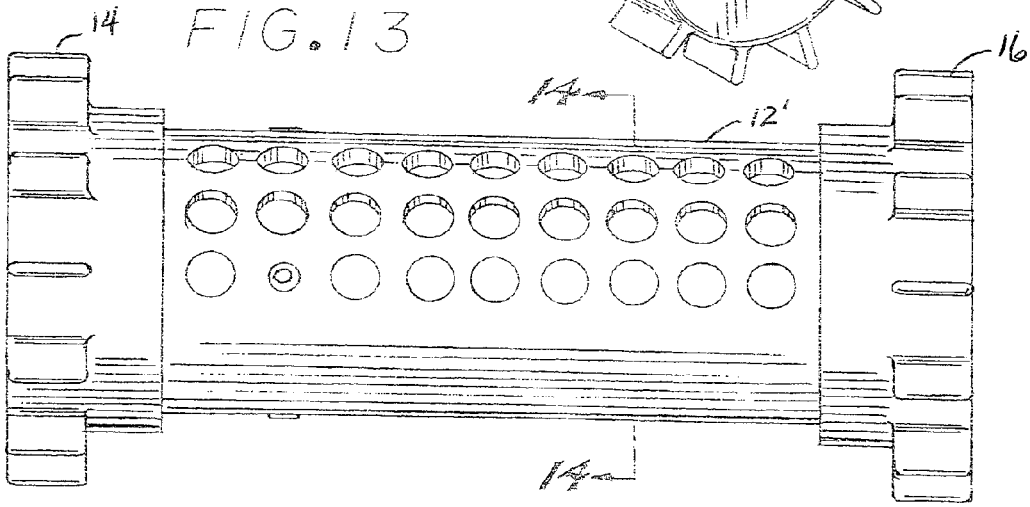
FIG. 13 is a side plan view of the device shown in FIG. 12.
Figure 14:
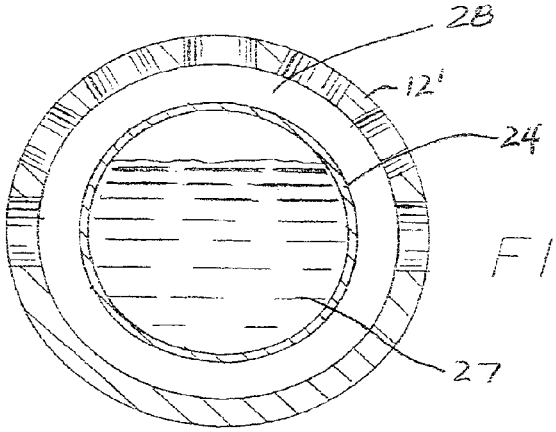
FIG. 14 is a cross-sectional view along line 14-14 of FIG. 13 showing the different hole pattern.

Referring now to the FIGS. 1-11, a first embodiment of the fireball generator device 10 of the present invention is illustrated (device 10 is essentially identical to the device embodiment shown in FIGS. 12-14 except that the housing hole patterns are different). Fireball generator 10 comprises main housing cylinder 12, preferably made of steel, and threaded end caps 14 and 16 also preferably made of steel. Cylinder 12 has slots 13 (FIGS. 6 and 8) formed in the end adjacent end cap 14 and a cutout 15 formed about the interior circumference of cylinder 12 adjacent end cap 16 as shown in FIG. 5. End caps 14 and 16 screw onto threads 19 formed on the ends of housing 12 as illustrated in FIG. 5. End caps 14 and 16 have a plurality of rib members 20 extending in a radial direction from the surface of the end caps, the rib members providing better gripping and turning features for a user and preventing device 10 from rolling around on the ground after device positioning. A plurality of venting holes 22 are formed around the entire circumference of housing cylinder 12 (360° pattern is illustrated). As shown in FIG. 5, a liquid propane (LP) tank 24 (or a same sized tank having an equivalent ignitable type gas, such as MAPP gas) having liquid propane gas 27 therein is positioned with the hollow interior area 28 of housing 12. Four guide screws 32 (FIG. 7) equispaced around the circumference of housing 12 secure and align tank 24 in place within interior area 28. A plastic cup 34 is positioned within a insert pipe sleeve 30, pipe sleeve 30 limiting, or reducing, gas generated when the black sporting powder placed in cup 34 is ignited. Pipe sleeve 30 slides into housing 12, stops at its shoulder and mates with cutout 15. The outside diameter of sleeve 30 is less than the inside diameter of housing 12 so that sleeve 30 can easily slide into housing 12 without the user having to exert undue force. Cutout 15 prevents the sleeve 30 from dropping down the housing to the other end. The user removes sleeve 30 by reaching inside and pulling it out from housing 12. An electric igniter is placed inside cup 34 and the igniter wires extend through a hole 40 formed in threaded end cap 16, the hole being sealed with clay or glue. A predetermined amount of black sporting powder 29 is poured into cup 34 (cup 34 is designed so that the user can not overfill the cup with black sporting powder which would create a dangerous condition) and then covered with threaded cap 42, cap 42 screwing inside of steel end cap 16. Cap 34 and cup 42 can either be pressed fit together and glued or screwed together (and glued if necessary). As will be explained hereinafter, the igniter, cup 34 and cap 42 are replaceable items. Cup 34 has a threaded recess well 41 to engage the threaded boss formed on the tank end preventing the tank 24 from moving if the device 10 itself is moved or repositioned.

A knife blade 50 having a triangular shaped protruding member 51, a sharp tip portion 52 and shoulders 59 is positioned in a manner such that flange ends 53 are positioned within end cap 14 and shoulders 59 slide into slots 13 formed in one of the threaded ends of housing 12. Shoulders 59, when inserted into slots 13, enable knife blade 50 to be correctly aligned inside housing 12.

Starting with the housing cylinder 12 and end caps 14 and 16, in order to fabricate the fireball generator of the present invention, a user unscrews the steel pipe main housing end cap 16 and then inserts tank 24 into the main housing 12. Tank 24 is positioned such that threaded boss 37 on the end of tank 24 screws into the threaded well 41 formed in cup 34. A small electric igniter (typically 12' long) is placed into the cup receptacle, the electric igniter lead wires (the part that hooks to a power source—battery, etc.) extending through a hole formed in plastic cap 42 and then through hole 40 formed in threaded cap 16. Device 10 is then moved to a predetermined area and long battery wires are connected to the igniter wires exiting pipe end cap 16. When all conditions are safe, the igniter inside cup 34 is activated via a battery or blasting machine.

The black sporting 29 powder explodes within cup 34 (see FIG. 11) melting the coupling between cup 34 and cap 42 and the high pressure gases pushes cup 34 against the top of the tank 24 forcing it forward at a high rate of speed. The gases are contained within a small area around the top of tank 24 to provide maximum gas pressure by using steel insert sleeve 30 positioned adjacent to the exterior wall of tank 24. As the tank 24 moves forward a few inches, the gas pressure safely escapes through a series of venting holes 22 formed around the housing circumference releasing the built up pressure. At this time, tank 12 slams into the knife blades 50 set inside the bottom of steel pipe cap end 14, ripping open the bottom of tank 24 and releasing gas 27. The gas is vented to the outside of the pipe 12 through the holes 22. At the same time gas 27 is released, it mixes with air and the black sporting powder, igniting the liquid gas and creating a consistent and predictable fireball.

To reuse, steel end cap 16 is opened and the tank 24, the cup 34 and cap 42 are replaced and the process started over again. Note that the knife blade 50 can be used over many times until it needs to be replaced. Mechanisms other than knife blade 50 can be used to rip open the bottom of tank 24, such as a steel punch.

Igniter components other than black sporting powder can be utilized with the fireball generator device of the present invention. For example, high pressure, inert gases such as dry nitrogen can be utilized. If this is the case, a different technique is necessary to ignite the liquid gas. For example, an electric pyrotechnic spark would ignite the released liquid gas when the tank is ruptured. Alternately, a flint can be designed into housing 12 so as the tank 24 is moving into the knife blade 50, it rubs the flint causing a spark to ignite the gas.

FIGS. 12-14 illustrate a second embodiment of a fireball generator, fireball generator 60 comprising a housing 12' wherein the series of patterned holes 22' is formed approximately 180° around the circumference of housing 12. Other than this differing hole pattern, the configuration of device 60 is identical to device 10.

The device of the present invention is not designed to be a weapon or destructive device and thus provides a simplified and economical device for generating an audible and visual fireball effect that provides a safe, consistent and predictable sized fireball effect for use within the entertainment industry and as a training aid for law enforcement, fire departments and other governmental agencies, the military and companies engaged in the business of security training.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A device for generating a fireball effect comprising:

a cylindrical housing having an outer surface, first and second threaded end cap portions and a hollow interior portion, said second threaded cap portion having an opening formed therein;

a container having an ignitable gas stored therein positioned within the hollow interior portion and having top and bottom portions, the top portion having a projection formed thereon;

a cup shaped member for storing an explosive material therein, said member having a recess for accepting the projection formed on said gas container and an opening for receiving said explosive material;

an igniter positioned in said cup for igniting said explosive material;

a cap positioned over said cup opening for maintaining said material within said cup;

a first pattern of holes formed along the outer surface of said housing for emitting burning gas; and a puncturing projection capable of puncturing said bottom portion of said container when the container impacts the projection with a predetermined force.

2. The device of claim 1 wherein said cap has an opening therein, an igniter wire positioned in said cup and extending through said cap opening and the opening in said second threaded cap portion.

3. The device of claim 1 wherein said projection comprises a knife blade.

4. The device of claim 1 wherein a plurality of rib members project from the outer surface of said first and second threaded cap members.

5. The device of claim 3 wherein said knife blade comprises a triangular shaped member having a tip portion positioned adjacent the bottom of said container and a base portion having first and second flange members, said flange members extending into slots formed in the interior surface of said first threaded cap portion.

6. The device of claim 1 further including a second pattern of holes formed along the outer surface of said housing, locating fasteners being positioned with said second pattern of holes to align said container within said housing interior portion.

* * * * *